US006278340B1

(12) United States Patent
Liu

(10) Patent No.: US 6,278,340 B1
(45) Date of Patent: Aug. 21, 2001

(54) MINIATURIZED BROADBAND BALUN TRANSFORMER HAVING BROADSIDE COUPLED LINES

(75) Inventor: Shih-Ping Liu, Kaohsiung (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/309,262

(22) Filed: May 11, 1999

(51) Int. Cl.[7] ..... H01P 5/10
(52) U.S. Cl. ..... 333/26; 333/33
(58) Field of Search ..... 333/26, 33

(56) References Cited

U.S. PATENT DOCUMENTS

| | | | | |
|---|---|---|---|---|
| 3,846,721 | * | 11/1974 | Fritz et al. | 333/26 |
| 4,460,877 | | 7/1984 | Sterns | 333/26 |
| 4,725,792 | | 2/1988 | Lampe, Jr. | 333/26 |
| 4,755,775 | | 7/1988 | Marczewski et al. | 333/26 |
| 4,847,626 | | 7/1989 | Kahler et al. | 343/700 MS |
| 4,994,755 | | 2/1991 | Titus et al. | 330/54 |
| 5,025,232 | | 6/1991 | Pavio | 333/26 |
| 5,039,891 | | 8/1991 | Wen et al. | 333/25 X |
| 5,172,082 | | 12/1992 | Livingston et al. | 333/26 |
| 5,296,823 | | 3/1994 | Dietrich | 333/26 |
| 5,455,545 | | 10/1995 | Garcia | 333/26 |
| 5,497,137 | | 3/1996 | Fujiki | 336/200 |
| 5,534,830 | | 7/1996 | Ralph | 333/128 |
| 5,574,411 | | 11/1996 | Apel et al. | 333/25 |
| 5,628,057 | * | 5/1997 | Phillips et al. | 333/26 X |
| 5,697,088 | | 12/1997 | Gu | 455/307 |

* cited by examiner

*Primary Examiner*—Benny Lee
(74) *Attorney, Agent, or Firm*—Stevens, Davis, Miller & Mosher, LLP

(57) ABSTRACT

A miniaturized wideband balun circuit is disclosed which includes a first dielectric substrate having substantially planar opposing surfaces; first and second conducting strips disposed on a first one of the opposing surfaces of the first dielectric substrate and each having a first terminal and a second terminal; a second dielectric substrate having substantially planar opposing surfaces, with a first one of the opposing surfaces of the second dielectric substrate being disposed over the first and second conducting strips; third and fourth conducting strips disposed on a second one of the opposing surfaces of the second dielectric layer and each having a first terminal and a second terminal The first and second conducting strips overlie the third and fourth conducting strips, respectively. The first and second terminals of the first conducting strip, the first terminal of the second conducting strip and the second terminal of the fourth conducting strip are electrically grounded. The first terminal of the third and fourth conducting strips are connected to an unbalanced port. The second terminal of the third conducting strip is connected to a first balanced port, and the second terminal of the second conducting strip is connected to a second balanced port.

13 Claims, 4 Drawing Sheets

MINIATURIZED BROADBAND BALUN TRANSFORMER HAVING BROADSIDE COUPLED LINES

BACKGROUND OF THE INVENTION

1. Field of the Invention

This invention relates to balun circuits for coupling between balanced and unbalanced lines or devices in an electronic system. More particularly, this invention relates to a miniaturized wideband multi-layer balun circuit for use in microwave and RF applications such as mobile communication devices.

2. Description of Related Art

Typically, a balun is used to couple a differential (balanced) circuit, such as a balanced amplifier, to a single-ended (unbalanced) circuit, such as an antenna. The following references provide background information relating to baluns and are incorporated by reference herein in their entireties:

[1] U.S. Pat. No. 4,994,755 to Titus et al., entitled "Active Balun," Feb. 19, 1991;

[2] U.S. Pat. No. 5,039,891 to Wen et al., entitled "Planar Broadband FET Balun," Aug. 13, 1991;

[3] U.S. Pat. No. 5,574,411 to Apel et al., entitled "Lumped Parameter Balun," Nov. 12, 1996;

[4] S. A. Maas, "Microwave Mixers", Artech House, pp 244–255, 1933;

[5] U.S. Pat. No. 5,455,545 to Garcia, entitled "Compact Low-loss Microwave Balun," Oct. 3, 1995;

[6] U.S. Pat. No. 4,725,792 to Lampe, Jr., entitled "Wideband Balun Realized By Equal-Power Divider and Short Circuit Stubs," Feb. 16, 1988;

[7] U.S. Pat. No. 4,460,877 to Sterns, entitled "Broad-Band Printed-Circuit Balun Employing Coupled Strip All Pass Filter," Jul. 17, 1984;

[8] U.S. Pat. No. 5,497,137 to Fujiki, entitled "Chip Type Transformer," Mar. 5, 1994;

[9] U.S. Pat. No. 5,025,232 to Pavio, entitled "Monolithic Multilayer Planar Transmission Line," Jan. 18, 1991;

[10] U.S. Pat. No. 4,847,626 to Kahler et al., entitled "Microstrip Balunz-Antenna," Jul. 11, 1989;

[11] U.S. Pat. No. 4,755,775 to Marczewski et al., entitled "Microwave Balun for Mixers and Modulators," Jul. 5, 1988;

[12] U.S. Pat. No. 5,172,082 to Livingston, et al., entitled "Multi-octave Bandwidth Balun," Dec. 15, 1992;

[13] U.S. Pat. No. 5,296,823 to Dietrich, entitled "Wideband Transmission Line Balun," Mar. 22, 1994;

[14] U.S. Pat. No. 5,534,830 to Ralph, entitled "Thick Film Balanced Line Structure, and Microwave Baluns, Resonators, Mixers, Splitters, and Filters constructed Therefrom," Jul. 9, 1996; and

[15] U.S. Pat. No. 5,697,088 to Gu, entitled "Balun Transformer," Dec. 9, 1997.

The term "balun" is a contraction of balanced to unbalanced. A balun is a RF balancing network or electric circuit for coupling an unbalanced line or device and a balanced line or device for the purpose of transforming from balanced to unbalanced or from unbalanced to balanced operation, with minimum transmission losses. A balun can be used with an unbalanced input and a pair of balanced outputs or, in the reverse situation, a pair of balanced sources and an unbalanced load. Baluns can be used to interface an unbalanced input with a balanced circuit by dividing the signal received at its unbalanced terminal equally to two balanced terminals and by providing the signal at one balanced terminal with a reference phase and the signal at the other balanced terminal with a phase equal to the reference phase plus or minus 180°. Baluns can be used to interface a balanced or differential input from a balanced port of a balanced circuit providing output signals which are equal in magnitude but 180° out-of-phase and an unbalanced load driven by a single-ended input signal. The balun combines the signals of the balanced input and provides the combined signal at an another port.

The balanced structure is usually needed in devices such as balanced mixers, modulators, attenuators, switches and differential amplifiers, since balanced circuits can provide better circuit-to-circuit isolation, dynamic range, and noise and spurious signal cancellation. A balanced load is defined as a circuit whose behavior is unaffected by reversing the polarity of the power delivered thereto. A balanced load presents the same impedance with respect to ground, at both ends or terminals. A balanced load is required at the end of a balanced structure to ensure that the signals at the balanced port will be equal and opposite in phase. Depending on the implementation, baluns can be divided into two groups: active and passive. Active baluns are described in references [1] and [2] and are constructed by using several transistors (so-called active devices). Although active baluns are very small, they are not generally preferred for the following reasons. First, due to the employment of active devices, noise will be introduced into the system. Also, active devices tend inherently to waste power; this makes them quite disadvantageous in radio telephone systems. Additionally, the low-cost fabrication of active baluns is limited to semiconductor manufacture. Conversely, passive baluns are quite popular. Passive baluns can be categorized into lumped-type baluns, coil-type baluns, and distributed-type baluns.

Lumped-element-type baluns are described in references [3] and [4]. Lumped-element baluns employ discrete components that are electrically connected, such as lumped element capacitors and lumped element inductors. Advantages of lumped-element-type baluns include small size and suitability for low frequency range usage. On the other hand, the performance of lumped-element-type baluns is not good in high frequency ranges (several Ghz), because the lumped elements are very lossy and difficult to control. Also, the operational bandwidth of lumped-element-type baluns is small (<10%, typically).

Coil-type baluns (trifilar transformers) are very popular in applications in the UHF band or lower frequency range. Shortcomings of the trifilar transformer include unacceptable lossiness in the frequency range higher than the UHF band, and barriers to miniaturization beyond a certain size.

There are many kinds of distributed-type baluns. A first type is the 180° hybrid device described in references [4] and [5]. They are constructed by several sections of quarter-wavelength transmission lines and a section of half-wavelength transmission line. The drawbacks of the 180° hybrid device are larger size, difficulty in achieving a high impedance transformation ratio, and limitation to a balanced pair of unbalanced outputs. A second type is the combination of a power divider and a 180° phase shifter as described in references [6] and [7]. Since the 180° phase shift is achieved by a half-wavelength length difference, the size is still too large. A third type is the well-known Marchand-type balun as described in references [8]–[11]. This type of balun has very wide bandwidth (multi-octave). Further, both the phase balance and the amplitude balance are excellent. Moreover, it can be applied not only in a balanced port (load) but also in a balanced pair of unbalanced transmission lines. A fourth type of balun can be classified as a transmission line balun as described in references [12]–[15]. This type of balun uses various manners of connections of coupled transmission lines for implementation and can usually provide satisfactory performance and bandwidths.

In general, low return loss, low insertion loss, and good balanced characteristics are required for balun applications. In addition, bandwidth is another figure of merit. A wideband balun can be used in applications where a wide range of frequencies is present, and alternatively, it can provide a single-device solution to many different narrow frequency band problems. Furthermore, wideband baluns can tolerate more fabrication variation in band-limited applications. However, most of the known wideband balun structures have relatively large sizes, which is sometimes unacceptable in modem wireless applications.

SUMMARY OF THE INVENTION

It is an object of the present invention to provide a miniatured balun with wide bandwidth.

It is another object of the present invention to provide a miniaturized wideband balun having an impedance transformation ratio yielding optimal bandwidth and electrical performance.

According to a first embodiment of the present invention, there is provided a balun circuit comprising a first dielectric substrate having substantially planar opposing surfaces; first and second conducting strips disposed on a first one of the opposing surfaces of the first dielectric substrate and each having a first terminal and a second terminal; a second dielectric substrate having substantially planar opposing surfaces, with a first one of the opposing surfaces of the second dielectric substrate being disposed over the first and second conducting strips; third and fourth conducting strips disposed on a second one of the opposing surfaces of the second dielectric layer and each having a first terminal and a second terminal; and a groundplane conductor disposed on a second one of the opposing surfaces of the first dielectric substrate. The first and second conducting strips overlie the third and fourth conducting strips, respectively. The first and second terminals of the first conducting strip, the first terminal of the second conducting strip and the second terminal of the fourth conducting strip are electrically grounded. The first terminal of each of the third and fourth conducting strips are connected to an unbalanced port. The second terminal of the third conducting strip is connected to a first balanced port, and the second terminal of the second conducting strip is connected to a second balanced port. The first through fourth conducting strips can have one of a straight configuration, a meandered configuration and a spiral configuration.

In one configuration of the first embodiment, the first and third conducting strips have substantially the same length and width, and the second and fourth conducting strips have substantially the same length and width, with the length of the second and fourth conducting strips being greater than the width of the first and third conducting strips, and the width of the second and fourth conducting strips being greater than that of the first and third conducting strips.

In another configuration of the first embodiment, the balun circuit further comprises a third dielectric substrate having substantially planar opposing surfaces, with a first one of the opposing surfaces of the third dielectric substrate overlying the third and fourth conducting strips disposed on the first opposing surface of the second dielectric substrate.

In accordance with another configuration of the first embodiment, the first and third conducting strips have a characteristic impedance which is different from the characteristic impedance of the second and fourth conducting strips and the first and third conducting strips have a length which is different from the length of the second and fourth strips.

The second embodiment is identical to the first embodiment except that it has a stripline configuration with a groundplane above the third dielectric substrate and a groundplane below the first dielectric substrate. When the balun of the present invention has an impedance transformation ratio of 1:2, it can achieve optimal bandwidth and electrical performance. On the other hand, if desired, the balun of the present invention can be structured to have an impedance transformation ratio of 1:1 or virtually any other impedance transformation ratio, but bandwidth may be sacrificed and greater return losses may occur.

DETAILED DESCRIPTION OF THE INVENTION

In accordance with a preferred embodiment of the present invention, two pairs of broadside-coupled transmission lines are combined together to form a 1:2 balun transformer with lower impedance at the unbalanced port and higher impedance at the balanced ports.

Figure 1:
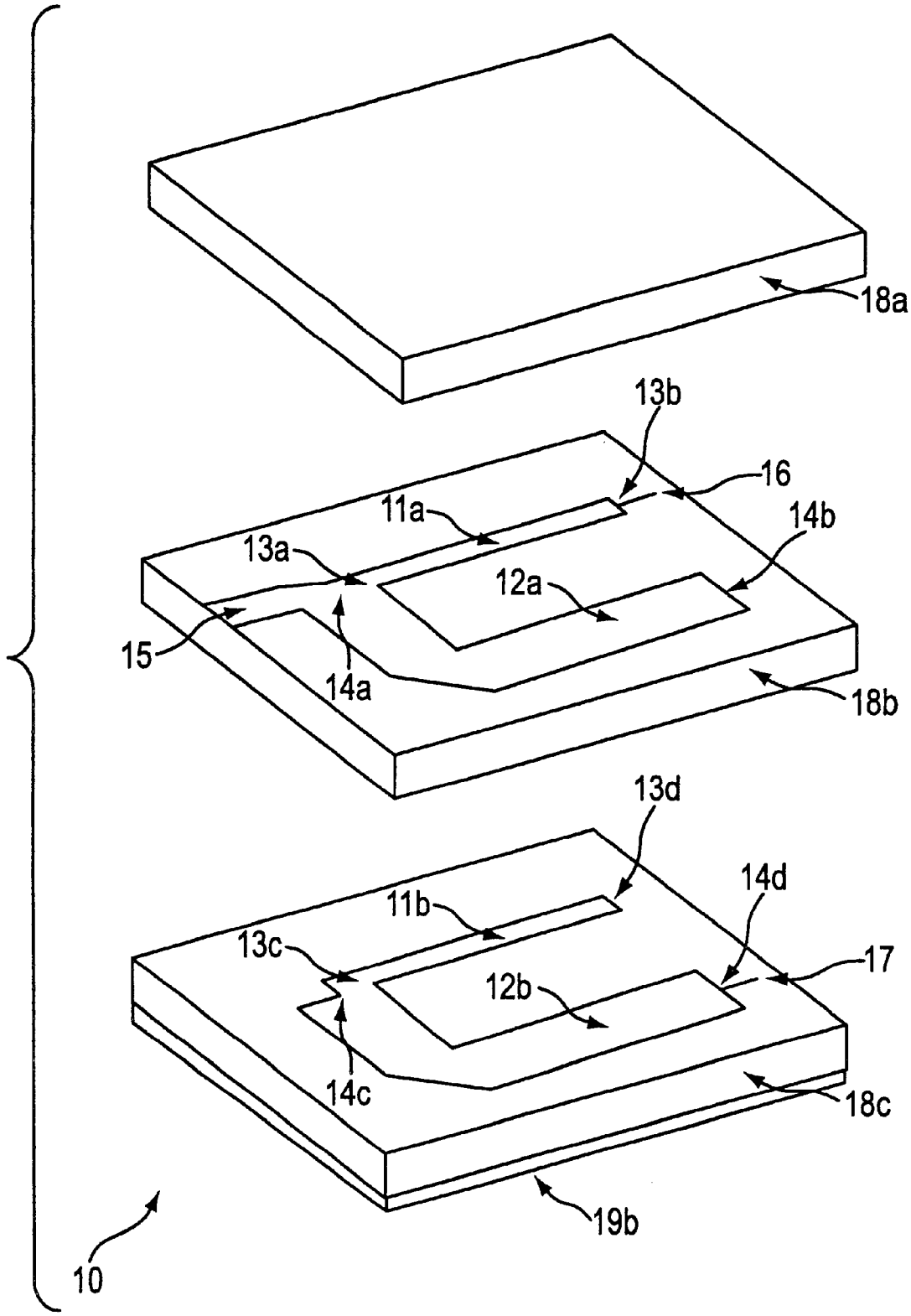
FIG. 1 is a perspective view of a first embodiment of the balun transformer in accordance with the present invention.

Referring to FIG. 1, there is shown a balun transformer 10 in accordance with the present invention. The balun transformer 10 includes first and second pairs of broadside-coupled transmission lines. The first pair of coupled lines comprises conductor strips 11*a* and 11*b*, while the second pair comprises conductor strips 12*a* and 12*b*. Conductor strips 11*a*, 11*b* are narrower and shorter than conductor strips 12*a*, 12*b*. Conductor strips 11*a*, 12*a* are disposed on the surface of dielectric substrate 18*b*. Conductors 11*b*, 12*b* are disposed on the surface of dielectric substrate 18*c*, which is beneath the substrate 18*b*. Ground plane 19*b* is placed beneath substrate 18*c*. A dielectric substrate 18*a* may be placed above the conductors 11*a*, 12*a* and substrate 18*b*. Substrates 18*a*–18*c* and ground plane 19*b* are stacked together in the assembled balun transformer.

Figure 2:
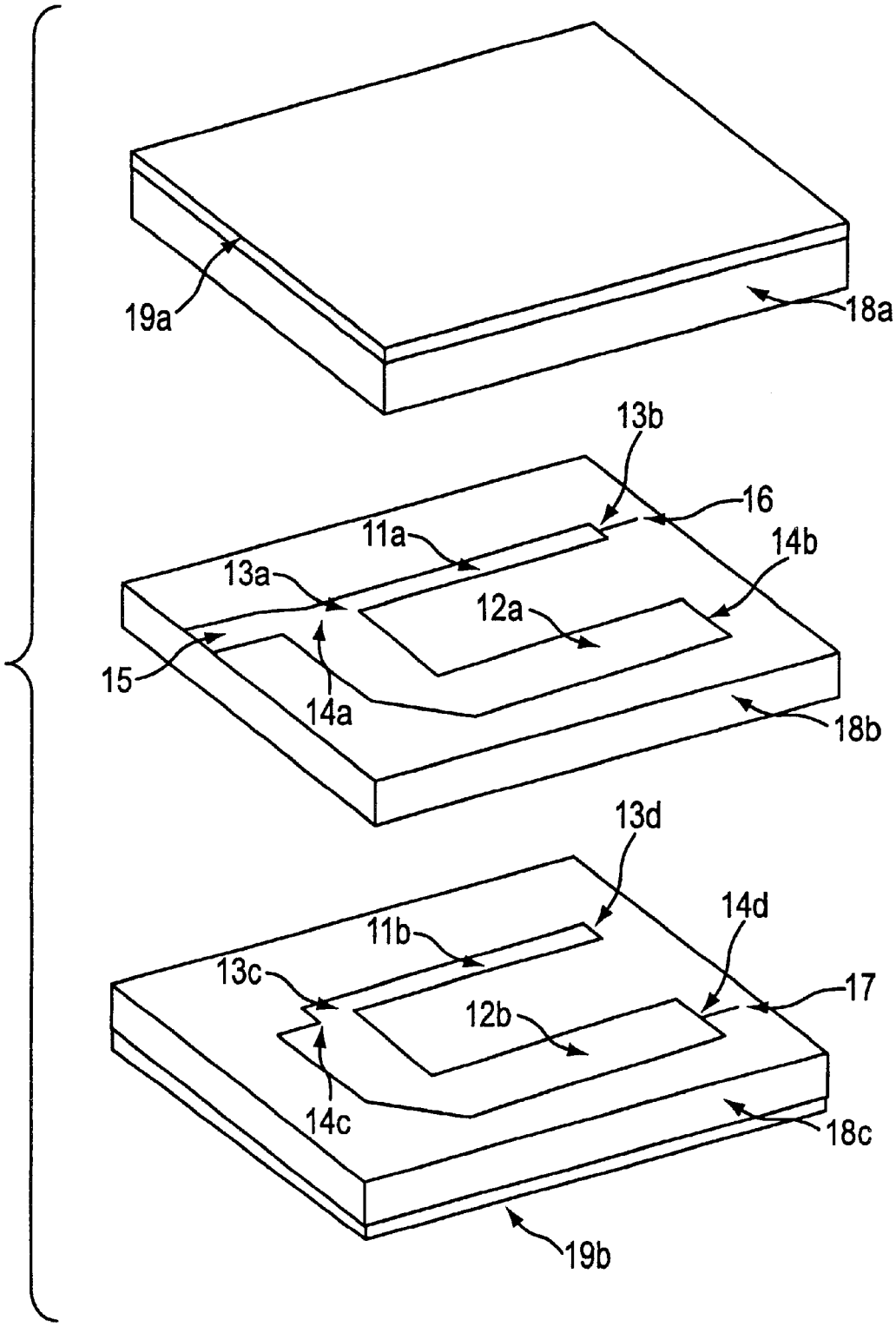
FIG. 2 is a perspective view of a second embodiment of the balun transformer in accordance with the present invention.

FIG. 2 shows a stripline configuration which is identical to FIG. 1 except that ground plane 19*a* is placed above substrate 18*a*. Substrates 18*a*, 18*b*, 18*c* and ground planes 19*a* and 19*b* are stacked together in the assembled balun transformer.

As shown in FIG. 1 and FIG. 2, the unbalanced port 15 is connected to the terminals 13*a* and 14*a* of the first and second pairs of coupled lines. The other terminal 13*b* of strip 11*a* is connected to port 16 which is one of the balanced ports. The terminal 14*d* of the second pair of coupled lines is connected to the other port 17 of the balanced ports. Ports 16 and 17 form a pair of balanced ports in the present invention. The rest of the terminals 13*c*, 13*d*, 14*b*, 14*c* of the two pairs of coupled lines are all connected to ground. Although not shown, the grounding can be realized by connecting via holes to ground planes 19*a* and 19*b* of FIG. 2 or by directly connecting to side ground-planes or side walls. Because the wider coupled lines, 12*a* and 12*b,* are typically longer than the narrower lines, 11*a* and 11*b,* the bending of conductive strips 12*a* and 12*b* as shown in FIGS. 1 and 2 is only one embodiment of the balun transformer of the present invention. Those persons who are skilled in the art will appreciate that the two pairs of coupled lines in the present invention can be configured in the form of straight lines, meandered lines or spiral lines.

Figure 3:
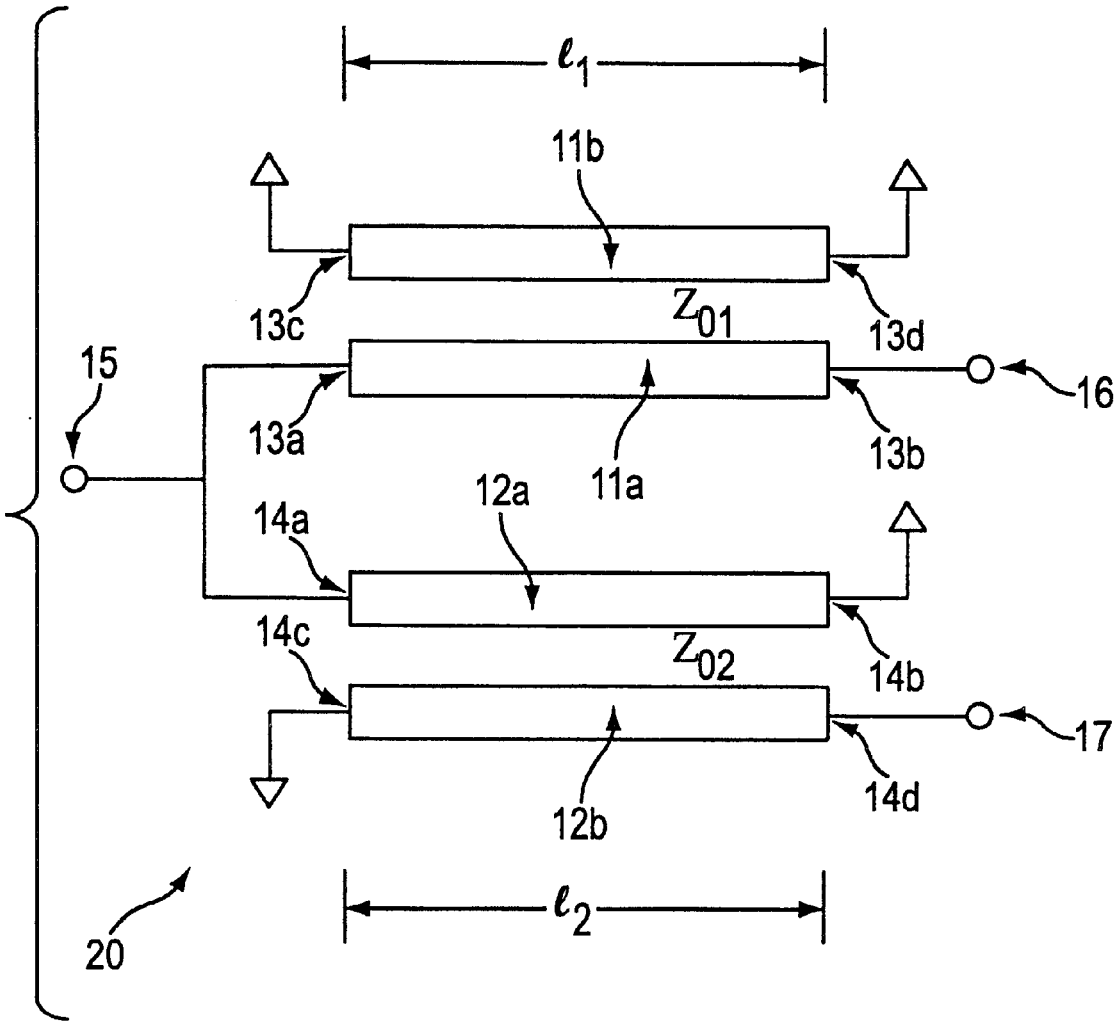
FIG. 3 is an equivalent schematic circuit of the balun transformer of FIG. 1.

In order to illustrate the concept underlying the present invention, FIG. 3 shows the equivalent schematic circuit 20 corresponding to the invention of FIGS. 1 and 2. The reference numerals in FIG. 3 also correspond to those in FIGS. 1 and 2 and are not described in detail for FIG. 3. The two coupled lines have respective characteristic impedances $Z_{01}$, $Z_{02}$, and strip lengths $l_1$, $l_2$, which are different from each other.

Figure 4:
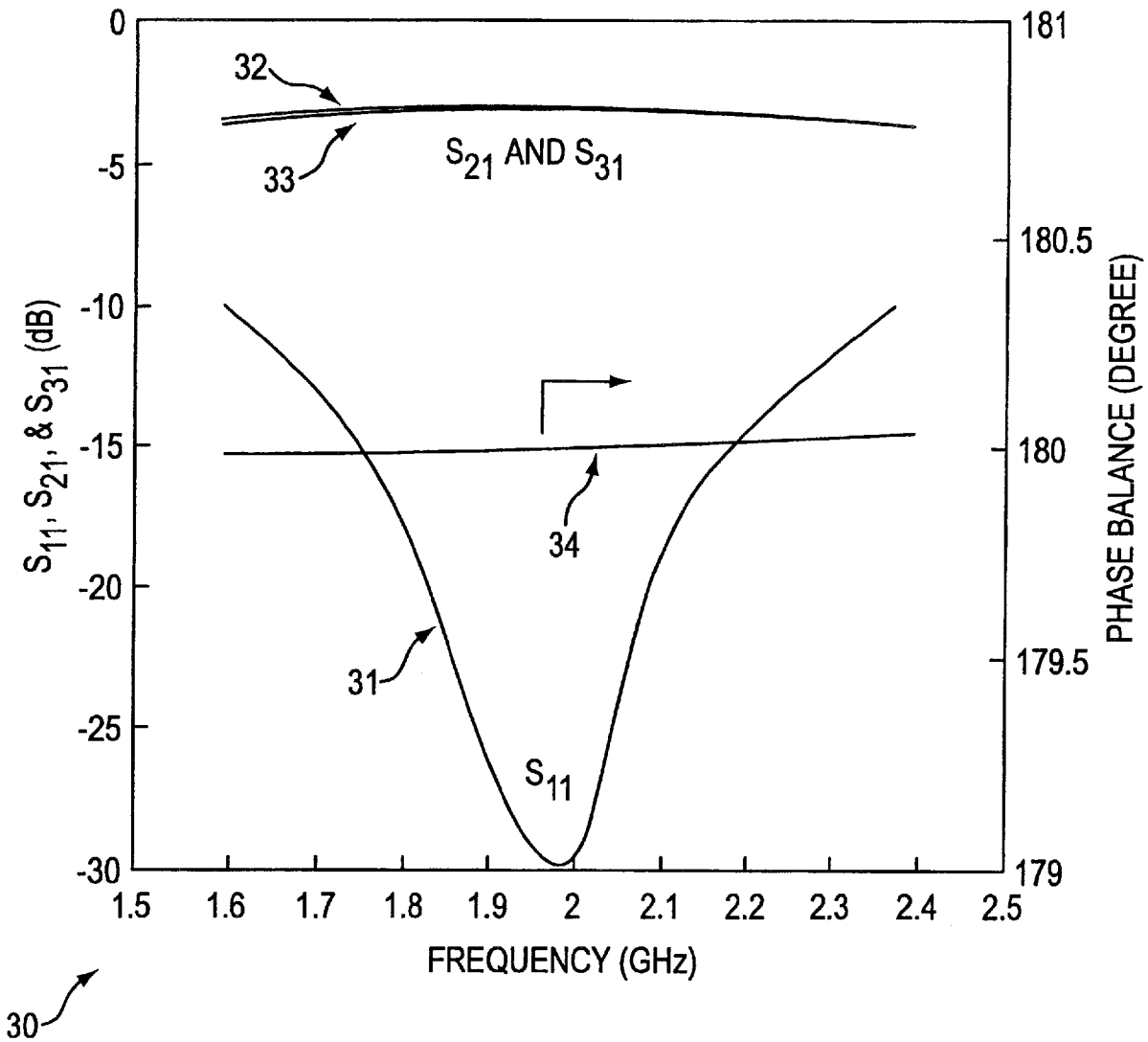
FIG. 4 is a typical graph of a simulated frequency response for the circuit of FIG. 1.

Referring now to FIG. 4, there is shown a graph 30 of a simulated frequency response for the balun transformer shown in FIG. 1. For this typical simulation, a 25-ohm to 50-ohm (1:2) balun transformer, using broadside-coupled striplines, is analyzed over a frequency range of 1.6 Ghz to 2.4 Ghz. The narrower coupled lines have a geometric mean value of characteristic impedance, $Z_{01}$, of 31 ohms and an electrical length, $l_1$ of 8 degrees at the center frequency 2 Ghz. The wider coupled lines have a geometric mean value of characteristic impedance $Z_{02}$ of 17 ohms and an electrical length $l_2$ of 19 degrees. It should be noted that the electrical length of these transmission lines is very short. The magnitude of the return loss $S_{11}$ at the unbalanced port is shown by reference numeral 31. The insertion losses between the unbalanced port and the first and second ports of the balanced ports $S_{21}$ and $S_{31}$ are represented by reference numerals 32 and 33, respectively. The phase balance at the two balanced ports is represented by reference numeral 34. As shown in FIG.4, within a bandwidth of 40 percent, the amplitude difference between the balanced ports is less than 0.3 dB and the variation of the phase balance at the balanced ports is less than 0.1 degrees. Furthermore, the return loss is less than −10 dB within the band.

EXAMPLE

A practical implementation of the present invention employs broadside-coupled striplines with conductors spaced by 4.3 mils to form a 1:2 balun transformer. The detailed structural parameters and the measured performances are as follows:

Structural Parameters

Total substrate thickness: 68.2 mils (between the top and bottom ground planes)

Relative dielectric constant: 7.8

Conductor spacing of the coupled striplines: 4.3 mils

Metalization thickness: 0.4 mils

The First Pair of Coupled Lines:

Conductor width: 6 mils

Transmission line length $l_1$: 98 mils

The Second Pair of Coupled Lines:

Conductor width: 30 mils

Transmission line length $l_2$: 227 mils

Measured Performance (25-ohm to 50-ohm)

Center frequency: 2 Ghz

Bandwidth: >40%

Return loss at the unbalanced port: <10 dB

Amplitude difference at the balanced ports: within ±1 dB

Phase balance at the balanced ports: within ±2 degrees

As described above, the total transmission line length $(l_1+l_2)$ for the experimental example is approximately equal to ⅙ wavelength. Accordingly, the simulated and experimental results, as described above, demonstrate that the present invention is a wideband and miniaturized balun transformer.

Although the present invention has been fully described by way of examples with reference to the accompanying drawings, it should be understood that numerous variations, modifications and substitutions, as well as rearrangements and combinations, of the preceding embodiments will be apparent to those skilled in the art without departing from the novel spirit and scope of this invention.

What is claimed is:

1. A balun circuit comprising:

(a) a first dielectric substrate having substantially planar opposing surfaces;

(b) a first conducting strip disposed on a first one of said opposing surfaces of said first dielectric substrate and having a first terminal and a second terminal;

(c) a second conducting strip disposed on said first one of said opposing surfaces of said first dielectric substrate and having a first terminal and a second terminal;

(d) a second dielectric substrate having substantially planar opposing surfaces, with a first one of said opposing surfaces of said second dielectric substrate being disposed over said first and second conducting strips disposed on said first opposing surface of said first dielectric substrate;

(e) a third conducting strip disposed on a second one of said opposing surfaces of said second dielectric layer and having a first terminal and a second terminal;

(f) a fourth conducting strip disposed on said second opposing surface of said second dielectric substrate and having a first terminal and a second terminal; and (g) a groundplane disposed on a second one of said opposing surfaces of said first dielectric substrate, wherein: said third conducting strip overlies said first conducting strip to form a first pair of broadside coupled lines, said fourth conducting strip overlies said second conducting strip to form a second pair of broadside coupled lines, said first terminal and said second terminal of said first conducting strip, said first terminal of said second conducting strip and said second terminal of said fourth conducting strip are electrically grounded, and said first terminal of said third conducting strip and said first terminal of said fourth conducting strip are connected to an unbalanced port, said second terminal of said third conducting strip is connected to a first balanced port, and said second terminal of said second conducting strip is connected to a second balanced port, wherein said first conducting strip and said third conducting strip have substantially the same length and width, and said second conducting strip and said fourth conducting strip have substantially the same length and width, said length of the second conducting strip and said fourth conducting strip being greater than said length of said first conducting strip and said third conducting strip, and said width of said second conducting strip and said fourth conducting strip being greater than said width of said first conducting strip and said third conducting strip.

2. A balun circuit as in claim 1, wherein said first through fourth conducting strips have respective physical parameters providing an impedance transfer ratio, defined as a ratio of an impedance at said unbalanced port and an impedance at said first and second balanced ports, which is greater than or equal to one.

3. A balun circuit as in claim 1, further comprising a third dielectric substrate having substantially planar opposing surfaces, with a first one of said opposing surfaces of said third dielectric substrate being disposed over said third conducting strip and said fourth conducting strip disposed on said first opposing surface of said second dielectric substrate.

4. A balun circuit as in claim 1, wherein said first through fourth conducting strips have respective physical parameters providing an impedance transfer ratio, defined as a ratio of an impedance at said unbalanced port and an impedance at said first and second balanced ports, which is less than or equal to one.

5. A balun circuit as in claim 4, wherein said impedance transfer ratio is 1:2.

6. A balun circuit as in claim 1, wherein said first conducting strip and said third conducting strip have a first characteristic impedance $Z_1$ and have a first length $L_1$, said third conducting strip and said fourth conducting strip have a second characteristic impedance $Z_2$ and a second length $L_2$, where $Z_1$ is different from $Z_2$ and $L_1$ is different from $L_2$.

7. A balun circuit as in claim 6, wherein $Z_1$ is greater than $Z_2$ and $L_1$ is less than $L_2$.

8. A balun circuit comprising:

(a) a first dielectric substrate having substantially planar opposing surfaces;

(b) a first conducting strip disposed on a first one of said opposing surfaces of said first dielectric substrate and having a first terminal and a second terminal;

(c) a second conducting strip disposed on said first one of said opposing surfaces of said first dielectric substrate and having a first terminal and a second terminal;

(d) a second dielectric substrate having substantially planar opposing surfaces, with a first one of said opposing surfaces of said second dielectric substrate being disposed over said first and second conducting strips disposed on said first opposing surface of said first dielectric substrate;

(e) a third conducting strip disposed on a second one of said opposing surfaces of said second dielectric layer and having a first terminal and a second terminal;

(f) a fourth conducting strip disposed on said second opposing surface of said second dielectric substrate and having a first terminal and a second terminal;

(g) a third dielectric substrate having substantially planar opposing surfaces, with a first one of said opposing surfaces of said third dielectric layer being disposed over said third conducting strip and said fourth conducting strip disposed on said second one of said opposing surfaces of said second dielectric layer;

(h) a first ground plane conductor layer disposed on a second one of said opposing surfaces of said first dielectric substrate; and (i) a second ground plane conductor layer disposed on a second one of said opposing surfaces of said third dielectric substrate, wherein:

said third conducting strip overlies said first conducting strip to form a first pair of broadside coupled lines, said fourth conducting strip overlies said second conducting strip to form a second pair of broadside coupled lines, said first terminal and said second terminal of said first conducting strip, said first terminal of said second conducting strip and said second terminal of said fourth conducting strip are electrically grounded, and said first terminal of said third conducting strip and said first terminal of said fourth conducting strip are connected to an unbalanced port, said second terminal of said third conducting strip is connected to a first balanced port, and said second terminal of said second conducting strip is connected to a second balanced port, wherein said first conducting strip and said third conducting strip have substantially the same length and width, and said second conducting strip and said fourth conducting strip have substantially the same length and width, said length of the second conducting strip and said fourth conducting strip being greater than said length of said first conducting strip and said third conducting strip, and said width of said second conducting strip and said fourth conducting strip being greater than said width of said first conducting strip and said third conducting strip.

9. A balun circuit as in claim 8, wherein said first conducting strip and said third conducting strip have a first characteristic impedance $Z_1$ and a first length $L_1$, said third conducting strip and said fourth conducting strip have a second characteristic impedance $Z_2$ and a second length $L_2$, where $Z_1$ is different from $Z_2$ and $L_1$ is different from $L_2$.

10. A balun circuit as in claim 9, wherein $Z_1$ is greater than $Z_2$ and $L_1$ is less than $L_2$.

11. A balun circuit as in claim 8, wherein said first through fourth conducting stripe have respective physical parameters providing an impedance transfer ratio, defined as a ratio of an impedance at said unbalanced port and an impedance at said first and second balanced ports, which is less than or equal to one.

12. A balun circuit as in claim 8 wherein said first through fourth conducting strips have respective physical parameters providing an impedance transfer ratio, defined as a ratio of an impedance at said unbalanced port and an impedance at said first and second balanced ports, which is greater than or equal to one.

13. A balun circuit as in claim 11, wherein said impedance transfer ratio is 1:2.

* * * * *